United States Patent [19]

Lombardo

[11] Patent Number: 4,987,694

[45] Date of Patent: Jan. 29, 1991

[54] GUN REST FOR CONTROLLING THE BUTTSTOCK

[76] Inventor: Philip C. Lombardo, 16422 Lassen St., Sepulveda, Calif. 91343

[21] Appl. No.: 427,487

[22] Filed: Oct. 26, 1987

Related U.S. Application Data

[63] Continuation-in-part of Ser. No. 320,710, Mar. 8, 1989, Pat. No. 4,876,814.

[51] Int. Cl.[5] ..... F41A 23/06

[52] U.S. Cl. ..... 42/94

[58] Field of Search ..... 42/94; 73/167; 89/37.04

[56] References Cited

U.S. PATENT DOCUMENTS

| | | | |
|---|---|---|---|
| 1,195,055 | 8/1916 | McNeal | 89/37.04 |
| 3,041,938 | 7/1962 | Seabrook | 42/94 |
| 4,333,385 | 6/1982 | Culver | 42/94 |
| 4,575,964 | 3/1986 | Griffin | 42/94 |
| 4,854,066 | 8/1989 | Canterbury | 42/ |
| 4,873,777 | 10/1989 | Southard | 42/94 |

*Primary Examiner*—Stephen C. Bentley

[57] ABSTRACT

An improved portable gun rest characterized by a mounting harness of a two strap configuration that holds the buttstock in a controlled and maneuverable position within an inverter U-shaped bracket that is rigidly fixed to a vertical slide which can raise and lower in elevation along the length of a vertical support shaft that terminates in a base member on its lowermost end. A recoil dampening pad attached to the rear of the gun rest provides protection from the recoil of the firearm.

9 Claims, 2 Drawing Sheets

GUN REST FOR CONTROLLING THE BUTTSTOCK

This is a continuation in part of application Ser. No. 07/320,710 filed Mar. 8, 1989, now U.S. Pat. No. 4,876,814.

BACKGROUND

1. Field of Invention

This invention relates to gun rests for firearms and more particularly to a new and improved portable gun rest which is used to support and control the buttstock of a firearm when shooting from the benchrest or prone on the ground position and which can be quickly removably mounted to provide a steady and adjustable rear rest for aiming the firearm at selected elevations.

2. Description of Prior Art

Obtaining the best accuracy is the shooters primary objective and the least amount of movement is objectionable. Breathing, heartbeat and the anticipation of the ensuing recoil of the firearm (commonly called flinching), are the primary source of movement.

In the prior art, various methods for constructing a gun rest to support and control the buttstock of a firearm have been used. As shown in applicants above mentioned prior patent application the gun rest disclosed therein features a pivoting attaching bracket having a substantially inverted J-shape with a pivot flange positioned at a right angle to its upper front edge, to pivotally connect said bracket to a vertical slide that adjusts for elevation. A locking flange positioned at a right angle to its lower front edge with an elongated pivot slot positioned therein to accept a lockscrew to releasably secure the pivotal action of said bracket, whereby the firearm is held in a controlled position and can be pivoted to adjust the firearm sights perfectly vertical for the proper eye to sight alignment and locked in place with said lockscrew.

Although applicants invention as shown in the above mentioned prior patent application has been recognized as a significant advance in the art, in some shooting situations it was found that the firearm should be allowed to move freely in the bracket. Locking the bracket in place made aiming and shooting follow up shots slow. Also, it is easier to make minute adjustments in aiming when the firearm is allowed some freedom of movement.

As the gun rest of the embodiment shown in applicants prior patent application is preferably made from metal, either by machining or casting or possibly molded from resinous plastic or the like, it is extremely important that the finished product be constructed with the use of a minimum amount of material and moving parts while still producing a structurally sound device. It is a well known fact within the manufacturing industry that the difference between success or failure of an article of manufacture is determined by a design employing the least amount of material and moving parts consistent with the production of a reliable product having a reasonably long service life.

SUMMARY OF THE INVENTION

A simplified embodiment eliminating elements and moving parts is incorporated in the present improved invention featuring a non-pivoting bracket substantially an inverted U-shape and rigidly attached to a vertical slide to adjust the elevation, a mounting harness of a two strap configuration holds the buttstock in a controlled and adjustable position within the U-shaped bracket. Essentially the U-shaped bracket cradles the uppermost rear portion of the buttstock and is secured with the mounting harness, which holds the buttstock within the U-shaped bracket and allows the buttstock to swivel somewhat like a ball and socket, giving the shooter the ease of adjustment and control needed for accurate shooting. Also, a recoil stabilizing plate is positioned to the rear of the bracket to keep the gun rest in the proper alignment during the stress of recoil. The U-shaped bracket is lined with a suitable padding material, such as leather or the like, to prevent marring and to allow the buttstock to swivel in the bracket and mounting harness. A recoil dampening pad mounted to the rear of the gun rest provides protection to the shooter from the recoil of the firearm.

Applicants improved and simplified construction comprises, a mounting harness and a U-shaped bracket that is rigidly fixed to a vertical slide, whereby eliminating the pivot flange, locking flange and pivotal lockscrew of applicants prior patent application without loss of capability, function or utility. The resulting improved gun rest is thus structurally stable while providing a sufficient degree of adjustability to improve aiming and shooting.

Accordingly, it is an object of the present invention to provide a new and improved portable gun rest for firearms which is adjustable, lightweight and removably mounted to the rear of the buttstock of substantially any firearm.

Yet another object of the present invention is to provide a new and improved portable gun rest for substantially any firearm which is characterized by a mounting harness that is of a two strap configuration that holds the buttstock in a steady and cradled position within a rigidly secured bracket, allowing the shooter to make sighting adjustments without pivoting components.

Yet another object of the present invention is to provide a new and improved portable gun rest for substantially any firearm which is characterized by a minimum of moving parts providing stronger construction and making manufacture more economical.

Yet another object of the present invention is to provide a new and improved portable gun rest for substantially any firearm which is characterized by versatility, i.e., the gun rest in one preferred embodiment can be assembled for righthand or lefthand shooters without the need for additional parts or tooling. In another preferred embodiment the gun rest can be used by righthand or lefthand shooters as is.

Yet another object of the present invention is to provide a new and improved portable gun rest for substantially any firearm which is characterized by a recoil dampening pad mounted to the rear of the gun rest permitting the shooter to concentrate on the target without the worry of flinching from the recoil of the firearm.

The advantage of a gun rest with a minimum of moving parts and thus easier to use without loss of capability, function or utility will be readily applauded by those skilled in the art, and appreciated by those at the shooting range or in the field. Also, a gun rest that holds a firearm perfectly steady and eliminates the pain and discomfort associated with shooting high powered firearms, due to the recoil dampening pad, will be appreciated by everyone.

Additional objects, advantages and characteristic features of the present invention will become readily apparent from the following detailed description of the preferred embodiments of the present invention when considered in conjunction with the accompanying drawings.

DESCRIPTION OF THE PREFERRED EMBODIMENTS

Figure 1:
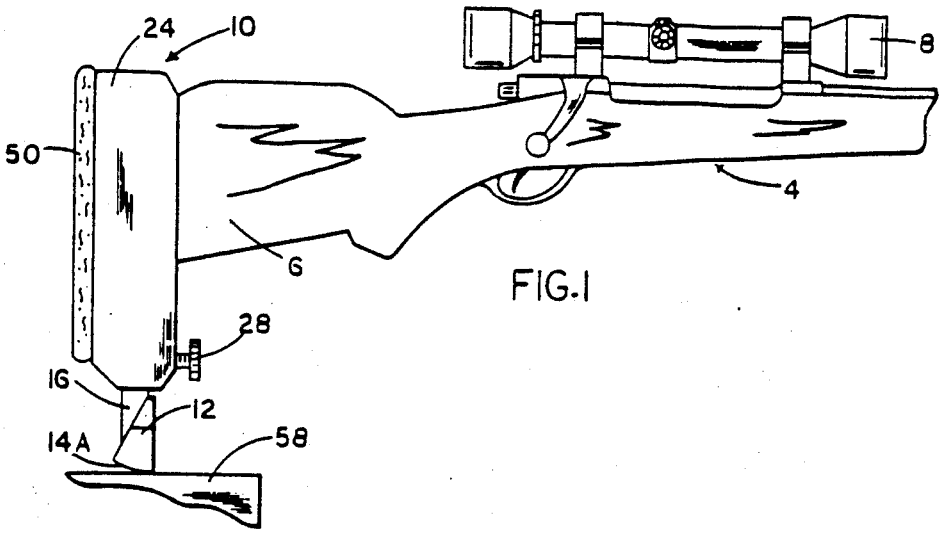
FIG. 1 is a side elevation view of a preferred embodiment of the invention secured to the buttstock of a rifle, with the vertical slide in its lowermost position.
Figure 2:
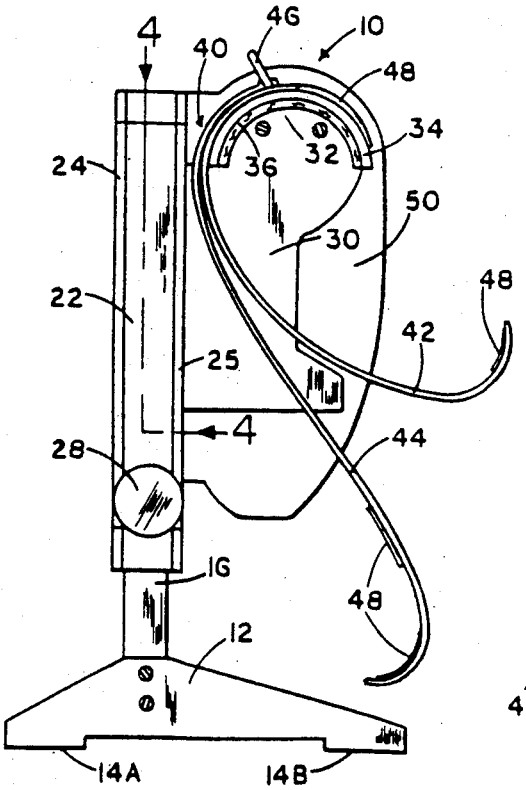
FIG. 2 is a front elevation view of the gun rest of FIG. 1 with the vertical slide in a partially elevated position.

Referring now to the drawings, and more particularly to FIG. 1-2, there is shown a gun rest of the present invention, broadly illustrated by numeral 10, mounted to buttstock 6 of rifle 4. Gun rest 10 includes a base 12, a vertical support shaft 16, a vertical slide 18, a recoil stabilizing plate 30, a bracket 34, a mounting harness 40 and a recoil dampening pad 50.

Figure 3:
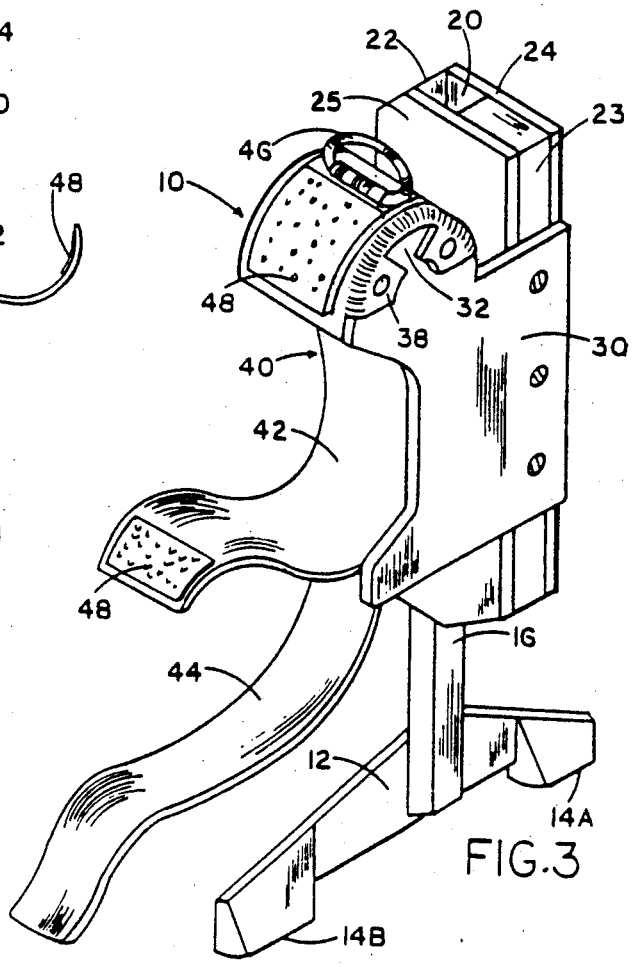
FIG. 3 is a perspective view of a preferred embodiment of the gun rest viewed from the rear, without the recoil dampening pad for clarity.

Base structure 12, best seen in FIGS. 2-3, includes feet 14*a-b* and a vertical support shaft 16. Base 12 is of a generally rectangular and elongated shape positioned horizontally and transversely to the general orientation of gun rest 10. Feet 14*a-b* extend downwardly past the under surface near each end of base 12 for engaging table top 58 (FIG. 1) or a similar structure. The bottom surface of feet 14*a-b* are slightly rounded to better slide over table top 58 during recoil of rifle 4. Vertical support shaft 16 is an elongated substantially rectangular member in its cross section, having its lowermost end securely fixed to base 12 at or about the midline of base 12. The upper end of vertical support shaft 16 is disposed to interconnect with vertical slide 18 through channel 20, as will be described presently.

Figure 4:
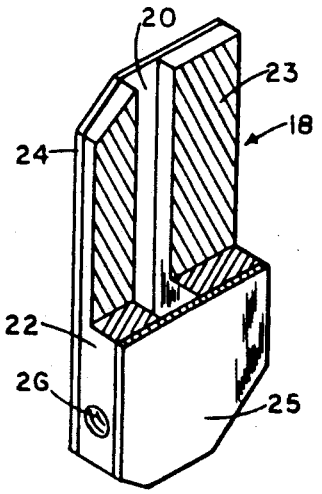
FIG. 4 is a perspective view of a preferred embodiment of the vertical slides construction taken along line 4—4 in FIG. 2.

In a preferred embodiment vertical slide 18 FIGS. 2-3-4, comprises a substantially rectangular shape of adequate dimension to receive channel 20 through its vertical length and threaded aperture 26 inwardly from its front surface, best seen in the section view of FIG. 4. A pair of parallel spaced bars 22 and 23 extend between and are securely fixed to a pair of side plates 24 and 25 with suitable fasteners (not characterized). The spaced relationship between bars 22 and 23, and side plates 24 and 25 define channel 20. Threaded aperture 26 extends inwardly through bar 22 to channel 20. Lockscrew 28 interconnects with threaded aperture 26 to abut vertical shaft 16, thus releasably securing vertical slide 18 at selected elevations along the length of vertical support shaft 16. A recoil stabilizing plate 30 is rigidly secured to the rear surface of bar 23 with suitable fasteners (not characterized). Recoil stabilizing plate 30 is substantially rectangular in shape with a rounded top 32 that conforms to the general shape of bracket 34, best seen in FIG. 3.

Bracket 34 FIGS. 2-3, has a substantially inverted U-shape and is dimensioned to cradle the top rear portion of buttstock 6 and is preferably made somewhat flexible to better conform to the varying thicknesses of buttstock 6 that are present throughout the firearm industry. A suitable padding material 36, such as leather or the like inner lines bracket 34 to prevent marring of buttstock 6 and also allows buttstock 6 to swivel in bracket 34, thus giving the needed adjustment for accurate shooting. A flange 38 is formed from the backedge of and at a right angle to bracket 34 and is configured to securely fix bracket 34 to recoil stabilizing plate 30 at rounded top 32 with suitable fasteners (not characterized).

Harness 40 is of a two strap configuration, best seen in FIGS. 2-3. Strap 42 is preferably made of an elastic type material. Strap 44 is preferably made of a non-elastic type material with a ring 46 fixed to one end. Strap 44 has its ring 46 end securely fixed to strap 42 near its upper end, thus forming harness 40. Harness 40 has the ring 46 end securely adhered to bracket 34 with a suitable adhesive. Strap 42 is of sufficient length to encircle buttstock 6 and is releasably secured to the upper surface of bracket 34 with a suitable fastener such as VELCRO brand hook and loop fastener or the like. Also, strap 44 is of sufficient length to encircle buttstock 6, pass through ring 46 and releasably secure back onto itself with a suitable fastener such as VELCRO brand hook and loop fastener 48 or the like when attaching gun rest 10 to buttstock 6.

Recoil dampening pad 50 FIGS. 1-2, is preferably made of a resilient material and sufficiently shaped and dimensioned to provide protection to the shooter from the recoil of rifle 4. Recoil dampening pad 50 in one preferred embodiment is releasably secured to gun rest 10 with VELCRO brand hook and loop fastener 48 type fastener (not characterized). In another preferred embodiment recoil dampening pad 50 is securely fastened to gun rest 10 with a suitable adhesive.

Figure 6:
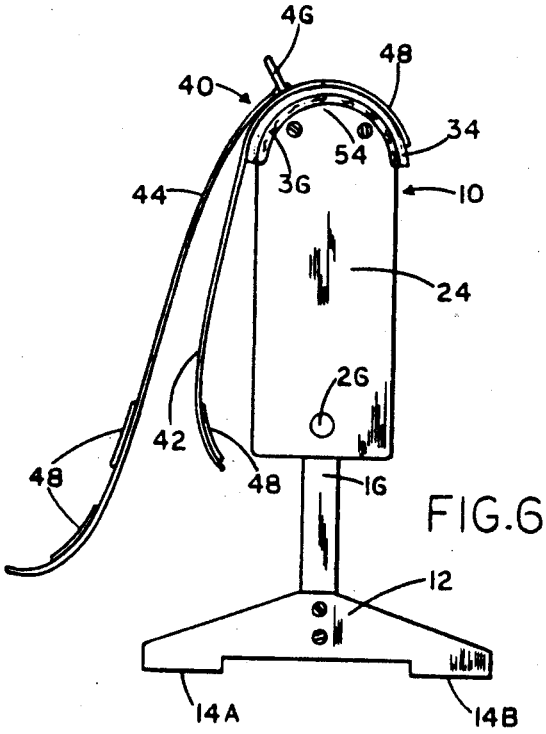
FIG. 6 is a front elevation view of another preferred embodiment of the invention.

In another preferred embodiment depicted in FIG. 6, vertical slide 18 is configured with side plate 24 having a rounded top 52. Bracket 34 is securely fixed to side plate 24 at rounded top 52. As can be seen from this configuration vertical slide 18 is positioned directly to the rear of bracket 34 and threaded aperture 26 is positioned in side plate 24.

Figure 5:
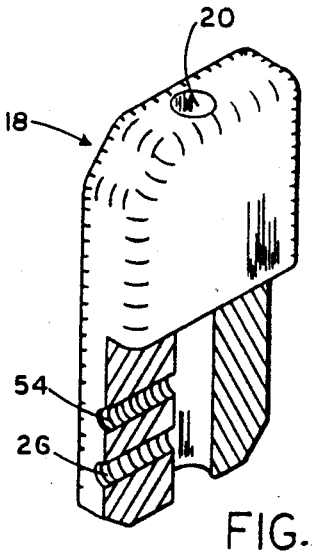
FIG. 5 is a perspective view of another preferred embodiment of the vertical slide partially cut away for clarity.

In yet another preferred embodiment depicted in FIG. 5, there is shown a representation of vertical slide 18 as it might appear cast from nonferrous metal with channel 20 taking a more cylindrical shape. Threaded apertures 26 and 54 extend inwardly from its front surface. Threaded aperture 26 is positioned to accept, a lockscrew (not characterized). Threaded aperture 54 is positioned to accept an alignment screw (not characterized) that gently abuts vertical shaft 16, thus stopping vertical support shaft 16 from turning in the cylindrical shaped channel 20.

Operation Of Gun Rest

The gun rest 10 of FIGS. 1-6, is capable of steadying and adjusting a firearm in a variety of shooting situations including bench rest target shooting, prone on the ground target shooting, and also can be used effectively in the field varmint shooting. However, users will find it most useful from the bench rest position, when used in conjunction with the shooters normal front resting procedure.

Accordingly, the shooter would fit bracket 34 as seen in FIG. 1, over the rear top portion of buttstock 6 of rifle 4, and secure it by stretching elastic strap 42 of mounting harness 40 around buttstock 6 and fasten it to the top of bracket 34, and then stretch strap 44 of mounting harness 40 around buttstock 6, through ring 46 and fasten strap 44 back onto itself. Buttstock 6 is now held firmly in a cradled position while providing a sufficient amount of pivotal movement in mounting harness 40 to give the shooter the ease of adjustment and control needed for accurate shooting. By twisting buttstock 6 in mounting harness 40, telescopic sight 8 or open sights can be adjusted at will by the shooter.

The shooter would now adjust gun rest 10 and rifle 4 to the proper elevation. By loosening lockscew 28 and lifting up or pushing down on buttstock 6 of rifle 4 vertical slide 18 is positioned along the length of vertical support shaft 16 to the desired elevation and releasably secured by tightening lockscrew 28.

While the above description contains many specificities, these should not be construed as limitations on the scope of the invention, but rather as an exemplification of the preferred embodiments thereof. Many other variations are possible. For example, gun rest 10 can be made with vertical support shaft 16 round, triangular or a plurality of shafts can be used. A spring could be positioned at the upper or lower end of vertical support shaft 16, thus making gun rest 10 spring loaded. Vertical support shaft 16 can be a threaded shaft with an adjustment nut mounted thereon, as the adjustment nut is turned the height of the gun rest is adjusted either higher or lower. Also, ring 46 of strap 44 of mounting harness 40 could be replaced with a self locking buckle. Buckles or snaps could be interchanged with VELCRO brand hook and loop fastener 48 Also, harness 40 could be of a one strap configuration.

It can be readily seen from the description and drawing figures that the present invention is condusive to many different forms of manufacture, i.e., the components of the invention can be manufactured from standard size bar and flat bar stock, they can be machined from solid stock, they can be cast from metal with anyone of the many casting procedures, such as permanent mold casting, die casting, shell mold casting or molded from plastic or the like.

Furthermore, the present invention provides a relatively simple device with respect to the prior art and applicants above mentioned prior patent application in that the present invention consists of only one movable component. Also, the invention in all of its design embodiments provides a highly reliable, lightweight and efficient gun rest, which achieves all the enumerated objectives, improves and simplifies the invention set forth in applicants above mentioned prior patent application and obtains new results therein, i.e., the ability to pivot the firearm without any pivoting components, thus providing the shooter with the ease of adjustment and control needed for accurate shooting and quicker follow up shots, plus providing a stronger more efficient and reliable gun rest.

Accordingly, the foregoing disclosure and description of the present invention are illustrative and explanatory thereof, and various changes in the size, shape, materials and manor of manufacture may be made without departing from the spirit of the invention. Therefore, I do not wish to be limited to the precise details of construction setforth, but desire to avail myself of such variations and modifications as come within the scope of the appended claims.

I claim:

1. A portable and adjustable gun rest for supporting and controlling a buttstock of a firearm comprising:

a vertical support assembly including a horizontal rigid base disposed transversely to the orientation of said firearm, having top and bottom surfaces, and front and rear sides;

an upwardly extending elongated support member issuing from and rigidly affixed to said base and effectively shaped and dimensioned to provide a rigid and secure vertical support;

a vertical adjustment means of sufficient dimension to receive an aperture through its vertical length and cooperatively interconnected with said elongated support member through said aperture, enabling said vertical adjustment means to raise and lower in elevation;

a cradle means comprising an inverted U-shaped bracket disposed to engage the uppermost rear portion of said buttstock, and a connecting means effectively dimensioned and positioned to rigidly affix said cradle means to said vertical adjustment means; and a harness means comprising a flexible type material of sufficient length to encircle said buttstock issuing from and securely affixed to said cradle means, and a fastening means affixed to at least one end of said flexible type material, whereby said firearm can be releasably secured within said cradle means, providing a firm and stable rear rest, while allowing a shooter and ease of maneuverability necessary for sighting and shooting.

2. The invention of claim 1 wherein said horizontal rigid base has a plurality of feet projecting downwardly from said bottom surface.

3. The invention of claim 2 wherein said feet are rounded on their bottom surface to better slide over a rough bench top during recoil of said firearm.

4. The invention of claim 1 wherein said upwardly extending elongated support member is rectangular in its cross section.

5. The invention of claim 1 wherein said aperture closely approximates the cross sectional shape of said elongated support member for a snug but slidingly interconnection.

6. The invention of claim 1 wherein said inverted U-shaped bracket is lined with a suitable padding material to prevent marring of, and allow freedom of movement to, said buttstock.

7. The invention of claim 1 wherein said connecting means is a flange extending from, and at a right angle to, the back edge of said inverted U-shaped bracket.

8. The invention of claim 1 wherein said harness means comprises a plurality of straps, of a flexible type material.

9. The invention of claim 1 wherein said fastening means is of the hook and loop type.

* * * * *